United States Patent [19]

Klasen et al.

[11] Patent Number: 4,540,207

[45] Date of Patent: Sep. 10, 1985

[54] REFRIGERATOR DOOR PULL AND LATCH ASSEMBLY

[75] Inventors: Daniel A. Klasen, Hudson; John F. Denucci, Roberts, both of Wis.

[73] Assignee: The Vollrath Company, Sheboygan, Wis.

[21] Appl. No.: 526,995

[22] Filed: Aug. 29, 1983

[51] Int. Cl.[3] ..... E05C 15/02

[52] U.S. Cl. ..... 292/341.17; 70/92; 70/465

[58] Field of Search ..... 292/DIG. 71, DIG. 65, 292/341.17, 213, 95, 101, 304; 70/92, 465

[56] References Cited

U.S. PATENT DOCUMENTS

| | | | |
|---|---|---|---|
| 562,137 | 6/1896 | MacDonald | 292/341.17 X |
| 1,011,556 | 12/1911 | Auger | 292/341.17 X |
| 2,034,199 | 3/1936 | North | 70/92 X |
| 3,412,586 | 11/1968 | Sterner | 70/92 |

*Primary Examiner*—Richard E. Moore

*Attorney, Agent, or Firm*—Dressler, Goldsmith, Shore, Sutker & Milnamow, Ltd.

[57] ABSTRACT

A refrigerator door pull and latch assembly in which the locking mechanism is disposed in the handle. The locking mechanism connected to a strike bolt assembly, which assembly has secured to one end thereof a safety release member. The door handle thus includes the locking mechanism and the locking mechanism can be disengaged from inside the refrigerator by operating the safety release lever.

4 Claims, 4 Drawing Figures

FIG. 1
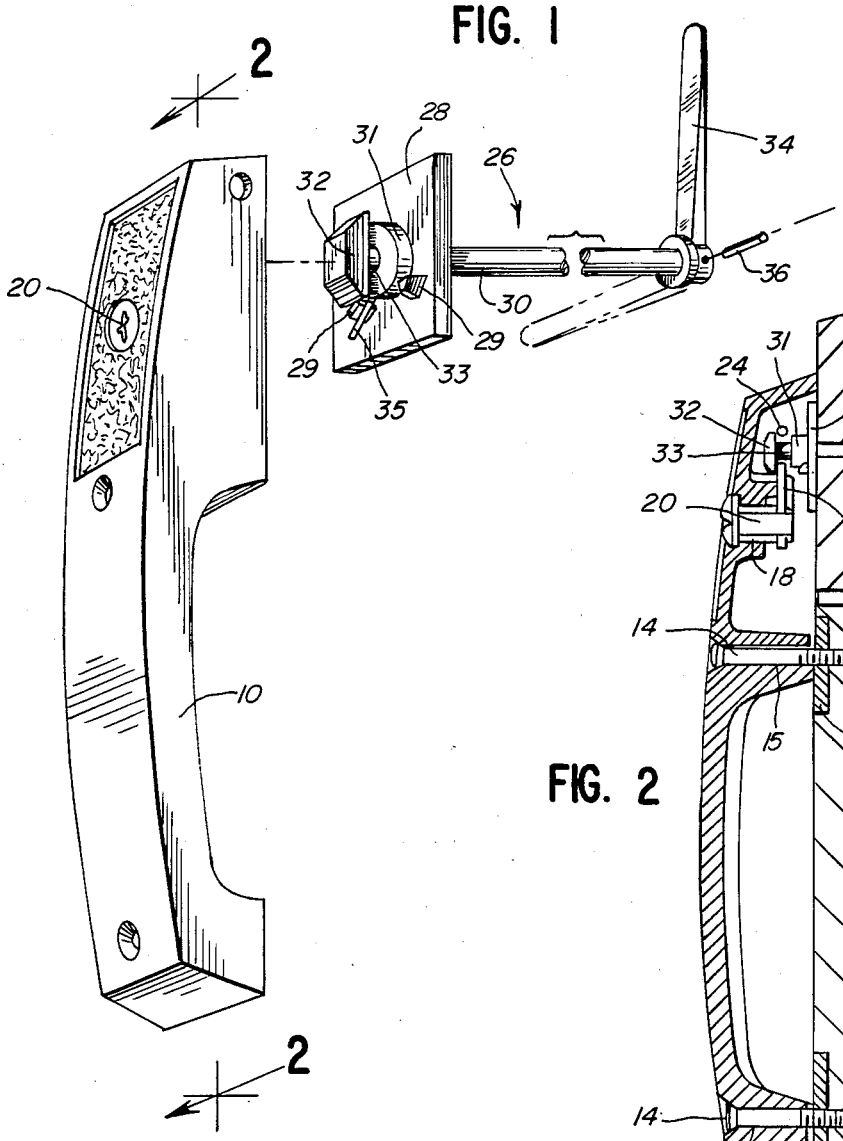
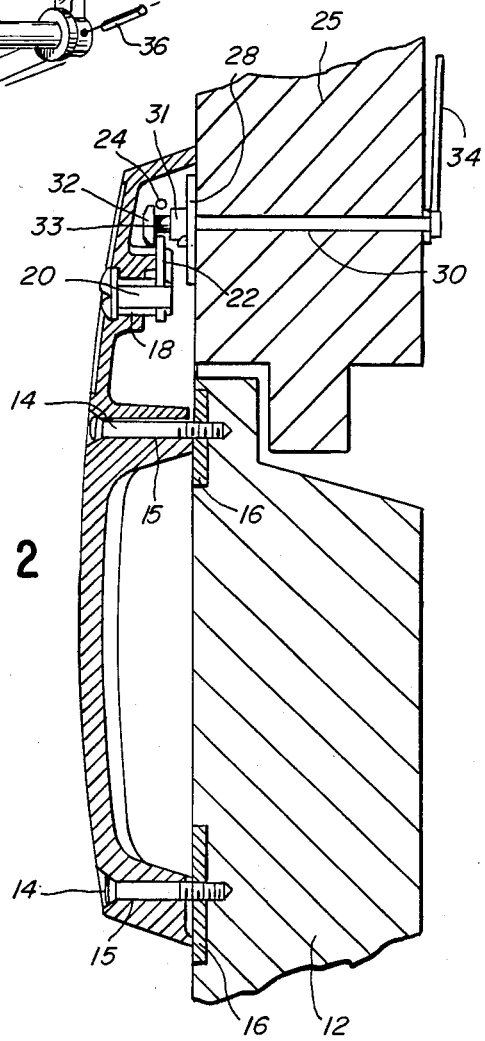
FIG. 2
FIG. 3
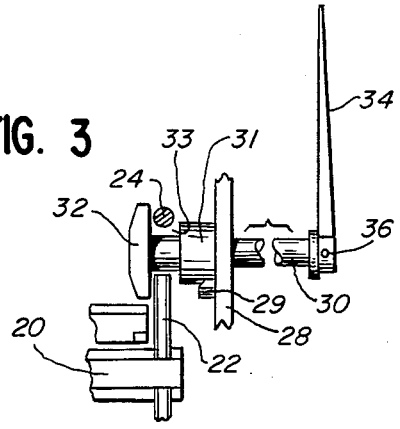
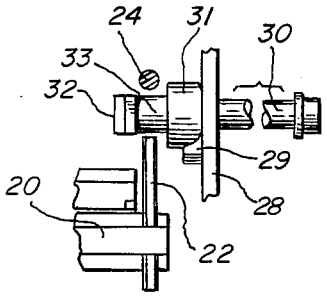
FIG. 4

REFRIGERATOR DOOR PULL AND LATCH ASSEMBLY

This invention relates to a novel door pull and latch assembly for a refrigerator door.

In presently existing conventional arrangements for opening and locking refrigerator doors, there are typically provided two handles which are used to perform the two separate functions. One or both of these handles have employed various moving parts which make for a relatively expensive arrangement with the possibility of wear, misallignment, or other deficiencies that could make replacement of the various parts necessary within a relatively short period of time. It can be appreciated that it would be desirable for the industry to have available to it a single door pull and latch assembly mechanism which performs both functions in a simple and efficient manner and further provides for inside release of the locking mechanism to avoid inadvertent entrapment of personnel within the refrigerator.

In accordance with the present invention, there is provided a novel door pull and latch assembly consisting of relatively few parts and which provides for inside release and padlock capabilities for locking the door in position while permitting ready unlocking of the door and opening and closing movement of the door as well as a simplified mechanism that permits ready release of the lock from the inside of the refrigerator in the event personnel are located within the refrigerator and the door is inadvertently locked from the outside.

This rather simple but novel and very unique construction consists of a handle which is secured to the door and in which is located a cylinder lock that when moved to the open position permits ready opening movement of the door by a single mechanism and when moved to the locking position prevents unauthorized entrance into the refrigerator. Furthermore, the simplified strike bolt assembly to which the pull handle is locked includes a safety release handle located within the refrigerator which when rotated moves the strike bolt assembly to an unlocked position so that even though the cylinder lock is in the locking position, a partial rotation of the safety release handle moves the strike bolt assembly out of engagement with the cylinder lock permitting the door to be opened.

The invention will be more clearly understood from the following description in conjunction with the attached drawings, in which:

FIG. 1 is an exploded view showing the strike bolt assembly in perspective and separate from the pull handle;

FIG. 2 is a cross-sectional view showing the novel door pull and latch assembly in cross section;

FIG. 3 is a partial view showing the relationship between the strike bolt assembly and cylinder lock when in the locked position; and FIG. 4 is a view showing the strike bolt assembly moved to the unlocked position by operation of the safety release handle from within the refrigerator.

Referring now to FIG. 1, there is shown in exploded perspective view the pull handle 10 which is secured to the door 12 by means of screws 14 extending through openings 15 in handle 10 and tapping plates 16 secured to the door 12. Located within an opening 18 in the door handle 10 is a conventional cylinder lock 20 which is adapted to be operated by a key. The cylinder lock includes at its inner end a locking member 22 having a semicircular portion 24 which performs the locking function with the strike bolt assembly 26. There is also provided an opening in the handle 10 through which a padlock can be inserted for locking the door, if desired. The strike bolt assembly 26 extends through the door frame 25 and includes a strike plate 28, at the outer end of the door frame 25, which strike plate is suitably secured to the door frame. Located on the strike plate are lugs 29, the function of which will be described hereinafter. The strike bolt assembly 26 includes a strike bolt 30 which defines at its upper end a head portion 32. Press-fitted to the bolt 30 above the strike plate is a collar 31 from which extends a pin 35 that moves between the lugs 29 when the strike bolt is rotated. Defined between the head portion 32 and the collar 31 is an annular groove 33 within which the semicircular portion 24 of the locking member 22 extends and locks the door 12 to the door frame 25 when the portion 24 is located in the groove 33 and the safety release lever is in the position shown in FIG. 2.

The safety release lever 34 is secured to the end of the strike bolt 30 by a roll pin 36. The head portion 32 is generally rectangular and as shown in FIG. 3, when the safety release lever has not been actuated, and is in its normal position, the door is not free to move relative to the door frame when the locking portion 24 is located within the annular groove 33. However, when the safety release lever 34 is moved approximately 90 degrees between the lugs 29 by someone within the refrigerator, the head portion which is rectangular, as shown in FIG. 1, is moved to the position shown in FIG. 4 where the narrow portion of the head is moved to the position shown in FIG. 4 and the locking portion 24 and thus the door 12 is free to move relative to the strike bolt assembly 26. This can occur since in such position the head portion 32 is no longer blocking the movement of the pull handle which thus permits the door to be opened from the interior of the refrigerator, even though the cylinder lock 20 has been moved to the locking position.

Thus, it can be seen that a novel and efficient door pull and latch assembly has been provided which has the dual function of serving as a handle for the door and a latch mechanism to facilitate locking of the door in position relative to the door frame. It is intended to cover by the appended claims all such modifications as fall within the terms thereof.

What is claimed is:

1. A refrigerator door pull and latch assembly comprising a door handle secured to a door, a locking mechanism disposed in said handle for locking the door to a door frame, said locking mechanism including a lock mounted in said door handle, a locking member including a semi-circular end portion connected to said lock and a locking member receiving means secured to said door frame, said receiving means comprising a strike bolt assembly defining a groove constructed and arranged to receive said semi-circular end portion when the locking mechanism is locked and including a safety release member for moving the strike bolt assembly to a position whereby the locking member is free of said lock member receiving means whereby the door can be opened independent of said lock.

2. A refrigerator door pull and latch assembly as set forth in claim 1 in which the strike bolt assembly includes a strike bolt extending through a strike plate secured to said door frame, said strike bolt having a head portion defining with said strike plate said groove within which said padlock member is received.

3. A refrigerator door pull and latch assembly as set forth in claim 2 in which the safety release lever is secured to the end of said strike bolt opposite said head portion and the head portion is constructed and arranged whereby when said safety release lever is moved a quarter turn the door handle is free of the strike bolt assembly and the door is free to open.

4. A refrigerator door pull and latch assembly as set forth in claim 2 in which the head portion of said strike plate assembly is generally rectangular and normally located in one position to prevent the door from being opened when the door lock is moved to the locking position and when the strike bolt assembly has been moved to a second position the head portion is free of said locking member, whereby the door can be moved to the open position even though the lock is in the locked position.

* * * * *